US005501835A

United States Patent [19]

Watanabe et al.

[11] Patent Number: 5,501,835

[45] Date of Patent: Mar. 26, 1996

[54] HEAT-RESISTANT, AUSTENITIC CAST STEEL AND EXHAUST EQUIPMENT MEMBER MADE THEREOF

[75] Inventors: Rikizou Watanabe, Mooka; Norio Takahashi, Ohmiya; Hirofumi Kimura, Mooka; Toshio Fujita, Tokyo, all of Japan

[73] Assignee: Hitachi Metals, Ltd., Japan

[21] Appl. No.: 350,145

[22] Filed: Nov. 29, 1994

[30] Foreign Application Priority Data

Feb. 16, 1994 [JP] Japan ..... 6-019420
Feb. 16, 1994 [JP] Japan ..... 6-019421

[51] Int. Cl.[6] ..... C22C 38/48

[52] U.S. Cl. ..... 420/54; 420/55

[58] Field of Search ..... 148/327; 420/53, 420/54, 55

[56] References Cited

U.S. PATENT DOCUMENTS

| | | | |
|---|---|---|---|
| 2,453,598 | 11/1948 | Schaefer et al. . | |
| 2,537,477 | 1/1951 | Mohling et al. . | |
| 4,248,629 | 2/1981 | Pons et al. | 420/55 |
| 5,194,220 | 3/1993 | Takahashi et al. . | |
| 5,194,221 | 3/1993 | Culling | 420/53 |

FOREIGN PATENT DOCUMENTS

| | | | |
|---|---|---|---|
| 0471255 | 2/1992 | European Pat. Off. . | |
| 0526174 | 2/1993 | European Pat. Off. . | |
| 0613960 | 9/1994 | European Pat. Off. . | |
| 1900300 | 10/1970 | Germany . | |
| 46-16812 | 5/1971 | Japan | 420/54 |
| 57-8183 | 2/1982 | Japan . | |
| 61-177352 | 2/1986 | Japan . | |
| 61-87852 | 5/1986 | Japan . | |
| 5-5161 | 1/1995 | Japan . | |
| 669579 | 4/1952 | United Kingdom . | |
| 746472 | 3/1956 | United Kingdom . | |
| WO91/16467 | 10/1991 | WIPO . | |

*Primary Examiner*—Deborah Yee
*Attorney, Agent, or Firm*—Finnegan, Henderson, Farabow, Garrett & Dunner

[57] ABSTRACT

Exhaust equipment members are made of a heat-resistant, austenitic cast steel with excellent castability and machinability having a composition consisting essentially, by weight, of 0.2–1% of C, 2% or less of Si, 2% or less of Mn, 8–20% of Ni, 15–30% of Cr, 0.5–6% of Nb, 1–6% of W, 0.01–0.3% of N, optionally 0.01–0.5% of S, C—Nb/8 being 0.05–0.6% and the balance being Fe and inevitable impurities.

10 Claims, No Drawings

HEAT-RESISTANT, AUSTENITIC CAST STEEL AND EXHAUST EQUIPMENT MEMBER MADE THEREOF

BACKGROUND OF THE INVENTION

The present invention relates to a heat-resistant cast steel suitable for exhaust equipment members for automobiles, etc., and an exhaust equipment member made of such a heat-resistant, austenitic cast steel. More specifically, it relates to a heat-resistant, austenitic cast steel with excellent castability and machinability and further excellent strength at 900° C. or higher and an exhaust equipment member made of such a heat-resistant, austenitic cast steel.

Some of conventional heat-resistant cast iron and heat-resistant cast steel have compositions shown in Table 1 as Comparative Examples. In exhaust equipment members such as exhaust manifolds, turbine housings, etc. for automobiles, heat-resistant cast iron such as NI-RESIST cast iron (Ni-Cr-Cu austenitic cast iron) and heat-resistant cast steel such as ferritic cast steel shown in Table 1 are employed because their operating conditions are extremely severe at high temperatures.

Further, attempts have been made to propose various types of heat-resistant, austenitic cast steel. For instance, Japanese Patent Laid-Open No. 61-87852 discloses a heat-resistant, austenitic cast steel consisting essentially of C, Si, Mn, N, Ni, Cr, V, Nb, Ti, B, W and Fe showing improved creep strength and yield strength. Japanese Patent Laid-Open No. 61-177352 discloses a heat-resistant, austenitic cast steel consisting essentially of C, Si, Mn, Cr, Ni, Al, Ti, B, Nb and Fe having improved high-temperature and room-temperature properties by choosing particular oxygen content and index of cleanliness of steel. Japanese Patent Publication No. 57-8183 discloses a heat-resistant, austenitic cast Fe-Ni-Cr steel having increased carbon content and containing Nb and Co, thereby showing improved high-temperature strength without suffering from a decrease in high-temperature oxidation resistance. Further, Japanese Patent Laid-Open No. 5-5161 discloses a heat-resistant, austenitic cast steel of Fe-Ni-Cr containing Nb, W, Mo, B and Co for drastically improving high-temperature strength.

Among these types of conventional heat-resistant cast iron and heat-resistant cast steel, for instance, the NI-RESIST cast iron is relatively good in a high-temperature strength at up to 900° C., but it is poor in durability at 900° C. or higher and expensive because of a high Ni content. On the other hand, the heat-resistant, ferritic cast steel is extremely poor in a high-temperature strength at 900° C. or higher.

Since the heat-resistant, austenitic cast steel disclosed in Japanese Patent Laid-Open No. 61-87852 has a relatively low C content of 0.15 weight % or less, it shows an insufficient high-temperature strength at 900° C. or higher. In addition, since it contains 0.002–0.5 weight % of Ti, harmful non-metallic inclusions may be formed by melting in the atmosphere.

In addition, since the heat-resistant, austenitic cast steel disclosed in Japanese Patent Laid-Open No. 61-177352 contains a large amount of Ni, it may suffer from cracks when used in an atmosphere containing sulfur (S) at a high temperature.

Further, since the heat-resistant, austenitic cast steel disclosed in Japanese Patent Publication No. 57-8183 has a high carbon (C) content, it may become brittle when operated at a high temperature for a long period of time.

The heat-resistant, austenitic cast steel disclosed in Japanese Patent Laid-Open No. 5-5161 is suitable for exhaust equipment members exposed to high temperatures, but it is inherently poor in castability and machinability as austenitic cast steel.

OBJECTS AND SUMMARY OF THE INVENTION

Accordingly, an object of the present invention is to provide a heat-resistant, austenitic cast steel with excellent castability and machinability, which can be produced at a low cost, thereby solving the above problems inherent in the conventional heat-resistant cast steel.

Another object of the present invention is to provide an exhaust equipment member made of such heat-resistant cast steel.

As a result of intense research in view of the above objects, the inventors have found that by adding Nb, W, N and optionally S to the heat-resistant Ni, Cr-base austenitic cast steel, the austenitic cast steel can be improved in high-temperature strength, castability and machinability. The present invention has been completed based upon this finding.

Thus, the first heat-resistant, austenitic cast steel with excellent castability and machinability according to the present invention has a composition consisting essentially, by weight, of:

C: 0.2–1%,
C—Nb/8: 0.05–0.6%
Si: 2% or less,
Mn: 2% or less,
Ni: 8–20%,
Cr: 15–30%,
Nb: 0.5–6%,
W: 1–6%,
N: 0.01–0.3%, and
Fe and inevitable impurities: balance.

The second heat-resistant, austenitic cast steel with excellent castability and machinability according to the present invention has a composition consisting essentially, by weight, of:

C: 0.2–1%,
C—Nb/8: 0.05–0.6%
Si: 2% or less,
Mn: 2% or less,
Ni: 8–20%,
Cr: 15–30%,
Nb: 0.5–6%,
W: 1–6%,
N: 0.01–0.3%,
S: 0.01–0.5 %, and
Fe and inevitable impurities: balance.

The exhaust equipment member according to the present invention is made of the above heat-resistant, austenitic cast steel.

DETAILED DESCRIPTION OF THE INVENTION

The reasons for restricting the composition range of each alloy element in the heat-resistant, austenitic cast steel of the present invention with excellent castability and machinability will be explained below. In the following explanation, the amount of each element is expressed simply by "%," but it should be noted that it means "% by weight."

(1) C (carbon): 0.2–1%

C has a function of improving the fluidity and castability of a melt and also partly dissolves into a matrix phase, thereby exhibiting a solution strengthening function. Besides, it forms primary and secondary carbides, thereby improving a high-temperature strength. C also forms eutectic carbides with Nb, enhancing castability. To exhibit such functions effectively, the amount of C should be 0.2% or more. However, if the amount of C exceeds 1%, various carbides including eutectic carbides are excessively precipitated, leading to a poor ductility and workability. Accordingly, the amount of C is 0.2–1%. The preferred amount of C is 0.3–0.6% when S is contained, and 0.2–6% when S is not contained.

(2) C—Nb/8: 0.05–0.6%

The heat-resistant, austenitic cast steel of the present invention has improved castability because of the existence of eutectic carbides of Nb, and improved high-temperature strength because of the precipitation of appropriate amounts of carbides.

The eutectic carbides (NbC) are formed from C and Nb at a weight ratio of 1:8. To obtain appropriate amounts of other carbides than the eutectic carbides (NbC), there should be a larger amount of C than that consumed by the eutectic carbides (NbC). Thus, C—Nb/8 should be 0.05% or more. However, if C—Nb/8 exceeds 0.6%, the heat-resistant, austenitic cast steel would become brittle, resulting in poor ductility and workability. Accordingly, C—Nb/ 8 is within the range of 0.05–0.6%. The preferred range of C—Nb/ 8 is 0.07–0.3%.

(3) Si (silicon): 2% or less

Si has a function as a deoxidizer and also is effective for improving an oxidation resistance. However, when it is excessively added, the austenite structure of the cast steel become unstable, leading to a poor high-temperature strength. Accordingly, the amount of Si should be 2% or less. The preferred amount of Si is 0.3–1.5%.

(4) Mn (manganese): 2% or less

Mn is effective like Si as a deoxidizer for the melt. However, when it is excessively added, its oxidation resistance is deteriorated. Accordingly, the amount of Mn is 2% or less. The preferred amount of Mn is 0.3–1.5%.

(5) Ni (nickel): 8–20%

Ni is an element effective for forming and stabilizing an austenire structure of the heat-resistant cast steel of the present invention together with Cr, thereby improving castability. Particularly, to have a good castability at 900° C. or higher, the amount of Ni should be 8% or more. As the amount of Ni increases, such effects increase. However, when it exceeds 20%, the effects level off, meaning that the amount of Ni exceeding 20% is economically disadvantageous. Accordingly, the amount of Ni is 8– 20%. The preferred amount of Ni is 8–15%.

(6) Cr (chromium): 15–30%

Cr is an element capable of austenizing the cast steel structure when it coexists with Ni, improving high-temperature strength and oxidation resistance. It also forms carbides, thereby further improving the high-temperature strength. To exhibit effectively such effects at a high temperature of 900° C. or higher, the amount of Cr should be 15% or more. However, if it exceeds 30%, secondary carbides are excessively precipitated and a brittle σ-phase, etc. are also precipitated, resulting in an extreme brittleness. Accordingly, the amount of Cr should be 15–30%. The preferred amount of Cr is 17–25%.

(7) Nb (niobium): 0.5–6%

Nb forms fine carbides when combined with C, increasing the high-temperature strength and thermal fatigue resistance. Also, by suppressing the formation of the Cr carbides, it functions to improve the oxidation resistance. Further, by forming eutectic carbides, it serves to improve the castability which is important for the cast articles having complicated shapes such as exhaust equipment members. For such purposes, the amount of Nb should be 0.5% or more. However, if it is excessively added, there are large amounts of eutectic carbides precipitated in the grain boundaries, resulting in deteriorated strength and ductility. Accordingly, the upper limit of Nb is 6%. The preferred amount of Nb is 1–4 %.

(8) W (tungsten): 1–6%

W has a function of improving the high-temperature strength. To exhibit such an effect effectively, the amount of W should be 1% or more. However, if it is excessively added, the oxidation resistance is deteriorated. Thus, the upper limit of W is 6%. The preferred amount of W is 2–4%. Since the same effects can be obtained by adding Mo, a part or all of W may be substituted by Mo at a weight ratio of W=2Mo.

(9) N (nitrogen): 0.01–0.3%

N is an element effective to produce an austenite structure and to stabilize an austenite matrix. It is also effective to make crystal grains finer. Thus, it is particularly useful for casting materials of the present invention which cannot be provided with fine crystal grains by forging, rolling, etc. The finer crystal grain structure makes it possible to have good ductility which is important for structural materials. N is also effective to eliminate the problem of poor machinability inherent in austenitic cast steel. In addition, since N is effective to retard the diffusion of C and the condensation of precipitated carbides, it is effective to prevent embrittlement.

To exhibit such functions effectively, the amount of N should be 0.01% or more. However, if the amount of N exceeds 0.3%, $Cr_2N$-$Cr_{23}C_6$ is precipitated in the crystal grain boundaries, causing embrittlement and reducing an amount of effective Cr, thereby deteriorating the oxidation resistance. Thus, the upper limit of N should be 0.3%. Accordingly, the amount of N is 0.01–0.3%. The preferred amount of N is 0.03–0.2%.

(10) S (sulfur): 0.01–0.5%

S is contained in the second heat-resistant, austenitic cast steel of the present invention. S has a function of forming fine spheroidal or granular sulfide particles in the cast steel, thereby improving machinability thereof, namely accelerating the separation of chips from a work being machined. Sulfides formed from S and Mn, etc. contribute to the improvement of castability like the eutectic carbides such as NbC, etc. To exhibit such an effect, the amount of S is preferably 0.01% or more. However, when it is excessively added, sulfide particles are excessively precipitated in grain boundaries, leading to a poor high-temperature strength. Thus, the upper limit of S is 0.5%. Therefore, when S is added, the amount of S is preferably 0.01–0.5%. The more preferred amount of S is 0.03–0.25 %.

The heat-resistant, austenitic cast steel of the present invention is particularly suitable for thin cast parts such as exhaust equipment members, for instance, exhaust manifolds, turbine housings, etc. for automobile engines which should be durable without suffering from cracks under heating-cooling cycles.

The present invention will be explained in detail by way of the following Examples and Comparative Examples without intention of restricting the scope of the present invention defined by the claims attached hereto.

Examples 1–10, and Comparative Examples 1–4

With respect to various types of heat-resistant, cast steel and iron having compositions shown in Table 1, Y-block test pieces (No. B according to JIS) were prepared by a casting process comprising melting the steel and iron in a 100-kg high-frequency furnace in the atmosphere, removing the resulting melt from the furnace while it was at a temperature of 1550° C. or higher, and pouring it into a mold at about 1500° C. or higher. The test pieces of the heat-resistant, austenitic cast steel of the present invention (Examples 1–10) showed good fluidity at casting, thereby generating no cast defects such as voids.

Next, test pieces (Y-blocks) of Examples 1–10 and Comparative Examples 1–4 were subjected to a heat treatment comprising heating them at 1000° C. for 2 hours in a furnace and leaving them to be cooled in the air.

In Table 1, the test pieces of Comparative Examples 1–4 are those used for heat-resistant parts such as turbo charger housings, exhaust manifolds, etc. for automobiles. The test pieces of Comparative Examples 1 and 2 are D2 and D5S of NI-RESIST cast iron. The test piece of Comparative Example 3 is a conventional heat-resistant, austenitic cast steel SCH-12 according to JIS. The test piece of Comparative Example 4 is a .heat-resistant, austenitic cast steel disclosed in Japanese Patent Laid-Open No. 5–5161.

TABLE 1

| | Additive Component (Weight %) | | | | | | | | |
|---|---|---|---|---|---|---|---|---|---|
| No | C | Si | Mn | Ni | Cr | W | Nb | N | C-Nb/8 |
| | | | | Example | | | | | |
| 1 | 0.22 | 0.75 | 0.75 | 8.21 | 16.88 | 1.21 | 1.20 | 0.03 | 0.07 |
| 2 | 0.41 | 0.58 | 0.98 | 10.10 | 20.02 | 3.01 | 2.02 | 0.09 | 0.16 |
| 3 | 0.52 | 0.63 | 0.82 | 19.55 | 29.72 | 5.95 | 2.66 | 0.18 | 0.19 |
| 4 | 0.41 | 0.52 | 0.88 | 10.15 | 20.05 | 3.05 | 1.88 | 0.09 | 0.16 |
| 5 | 0.56 | 0.82 | 1.05 | 10.65 | 21.25 | 3.38 | 3.95 | 0.06 | 0.06 |
| 6 | 0.49 | 1.01 | 0.75 | 10.33 | 20.54 | 3.15 | 2.11 | 0.27 | 0.23 |
| 7 | 0.72 | 0.95 | 0.66 | 10.51 | 20.23 | 2.88 | 1.12 | 0.18 | 0.58 |
| 8 | 0.94 | 1.01 | 0.75 | 10.31 | 19.92 | 3.11 | 5.66 | 0.09 | 0.23 |
| 9 | 0.62 | 0.85 | 0.48 | 9.65 | 20.85 | 3.25 | 1.68 | 0.10 | 0.41 |
| 10 | 0.47 | 0.92 | 0.66 | 10.09 | 21.23 | 2.66 | 2.02 | 0.12 | 0.22 |
| | | | | Comparative Example | | | | | |
| 1 | 2.77 | 2.12 | 0.88 | 21.10 | 2.44 | — | — | — | — |
| 2 | 1.89 | 5.32 | 0.41 | 34.50 | 2.35 | — | — | — | — |
| 3 | 0.21 | 1.24 | 0.50 | 9.10 | 18.80 | — | — | — | — |
| 4* | 0.41 | 1.02 | 0.48 | 10.50 | 20.08 | 3.01 | 0.49 | — | 0.34 |

Note: *Comparative Example 4 contained 0.005% of B.

Next, with respect to each cast test piece, the following evaluation tests were conducted.

(1) Tensile test at a room temperature

Conducted on a rod test piece (No. 4 test piece according to JIS) having a gauge distance of 50 mm and a gauge diameter of 14 mm.

(2) Tensile test at a high temperature

Conducted on a flanged test piece having a gauge distance of 50 mm and a gauge diameter of 10 mm at 1000° C.

(3) Thermal fatigue test

Using a rod test piece having a gauge distance of 20 mm and a gauge diameter of 10 mm, a heating-cooling cycle was repeated to cause thermal fatigue failure in a state where expansion and shrinkage due to heating and cooling were completely restrained mechanically, under the following conditions:

| | |
|---|---|
| Lowest temperature: | 150° C., |
| Highest temperature: | 1000° C., |
| Each 1 cycle: | 12 minutes, and |
| Test machine: | Electric-hydraulic servo-type thermal fatigue test machine. |

(4) Oxidation test

A rod test piece having a diameter of 10 mm and a length of 20 mm was kept at 1000° C. for 200 hours in the air, and its oxide scale was removed by shot blasting to measure a weight loss per a unit surface area. By calculating oxidation weight loss (mg/mm$^2$) after the oxidation test, the oxidation resistance was evaluated.

(5) Machinability test

A drilling test was conducted to evaluate machinability which was most critical at drilling a work made of this kind of material. A test piece made of each cast steel or iron was drilled ten times to measure the amount of flank wear of the drill and calculate the flank wear per one cut hole under the following conditions:

| | |
|---|---|
| Machine tool: | Vertical Machining Center (5.5 kW), |
| Drill: | Solid Carbide Drill (6.8 mm in diameter), |
| Cutting Speed: | 40 m/min, |
| Feed Speed: | 0.2 mm/rev., step feed, |
| Hole Depth: | 20 mm, |
| Entire Length of Drill: | 42 mm, and |
| Cutting Fluid: | Oil. |

The results of the tensile test at a room temperature, the tensile test at 1000° C., the thermal fatigue test and the oxidation test, and the drilling test are shown in Tables 2, 3, 4, and 5, respectively.

TABLE 2

| | at Room Temperature | | | |
|---|---|---|---|---|
| No. | 0.2% Offset Yield Strength (MPa) | Tensile Strength (MPa) | Elongation (%) | Hardness ($H_B$) |
| | | Example | | |
| 1 | 250 | 460 | 17 | 179 |
| 2 | 295 | 525 | 14 | 187 |
| 3 | 360 | 575 | 7 | 197 |
| 4 | 300 | 545 | 11 | 192 |
| 5 | 365 | 590 | 7 | 192 |
| 6 | 350 | 560 | 12 | 192 |
| 7 | 275 | 610 | 8 | 207 |
| 8 | 380 | 620 | 8 | 223 |
| 9 | 365 | 585 | 9 | 207 |
| 10 | 340 | 560 | 12 | 192 |
| | | Comparative Example | | |
| 1 | 190 | 455 | 16 | 179 |
| 2 | 255 | 485 | 9 | 163 |
| 3 | 250 | 560 | 20 | 170 |
| 4 | 350 | 560 | 4 | 201 |

TABLE 3

| No. | 0.2% Offset Yield Strength (MPa) | Tensile Strength (MPa) | Elongation (%) |
|---|---|---|---|
| | at 1000° C. | | |
| | Example | | |
| 1 | 40 | 64 | 68 |
| 2 | 47 | 75 | 49 |
| 3 | 72 | 115 | 37 |
| 4 | 52 | 90 | 42 |
| 5 | 68 | 105 | 38 |
| 6 | 62 | 100 | 26 |
| 7 | 75 | 110 | 26 |
| 8 | 78 | 115 | 22 |
| 9 | 70 | 105 | 20 |
| 10 | 64 | 100 | 33 |
| | Comparative Example | | |
| 1 | 33 | 41 | 33 |
| 2 | 33 | 44 | 29 |
| 3 | 35 | 55 | 49 |
| 4 | 66 | 108 | 26 |

TABLE 4

| No. | Thermal Fatigue Life (Cycle) | Weight Loss by Oxidation (mg/mm$^2$) |
|---|---|---|
| | Example | |
| 1 | 120 | 38 |
| 2 | 130 | 32 |
| 3 | 185 | 15 |
| 4 | 175 | 30 |
| 5 | 180 | 28 |
| 6 | 185 | 33 |
| 7 | 205 | 22 |
| 8 | 220 | 46 |
| 9 | 195 | 48 |
| 10 | 175 | 25 |
| | Comparative Example | |
| 1 | 56 | 765 |
| 2 | 85 | 55 |
| 3 | 80 | 85 |
| 4 | 180 | 25 |

TABLE 5

| No. | Flank Wear per One Cut Hole (mm) |
|---|---|
| | Example |
| 1 | 0.062 |
| 2 | 0.052 |
| 3 | 0.052 |
| 4 | 0.045 |
| 5 | 0.058 |
| 6 | 0.035 |
| 7 | 0.045 |
| 8 | 0.040 |
| 9 | 0.035 |
| 10 | 0.041 |
| | Comparative Example |
| 1 | 0.005 |
| 2 | 0.005 |
| 3 | 0.095 |
| 4 | 0.105 |

As is clear from Table 2, the test pieces of Examples 1–10 are comparable to or even superior to those of Comparative Examples 1 and 2 (NI-RESIST D2 and D5S) and Comparative Example 3 (SCH12) with respect to properties at a room temperature. Also, as is clear from Tables 3 and 4, the test pieces of Examples 1–10 are superior to those of Comparative Examples 1–3 with respect to the high-temperature properties (0.2% offset yield strength, tensile strength, thermal fatigue life and weight loss by oxidation). In addition, the test pieces of Examples 1–10 are comparable to the heat-resistant, austenitic cast steel disclosed in Japanese Patent Laid-Open No. 5–5161 (Comparative Example 4) in mechanical properties.

As is clear from Table 5, since the heat-resistant, austenitic cast steel of the present invention contains an appropriate amount of N and has well balanced amounts of C and Nb expressed by (C—Nb/8), it is much superior in machinability to the heat-resistant, austenitic east steel of Comparative Examples 3 and 4.

Next, an exhaust manifold (thickness: 2.0–2.5 mm) and a turbine housing (thickness: 2.5–3.5 mm) were produced by casting the heat-resistant, austenitic cast steel of Example 2. All of the resulting heat-resistant east steel parts were free from casting defects. These cast parts were machined to evaluate their machinability. As a result, no problem was found in any east parts.

Further, the exhaust manifold and the turbine housing were mounted to a high-performance, straight-type, four-cylinder, 2000-cc gasoline engine (test machine) to conduct a durability test. The test was conducted by repeating 500 heating-cooling (Go-Stop) cycles each consisting of a continuous full-load operation at 6000 rpm (14 minutes), idling (1 minute), complete stop (14 minutes) and idling (1 minute) in this order. The exhaust gas temperature under a full load was 1050° C. at the inlet of the turbo charger housing. Under this condition, the highest surface temperature of the exhaust manifold was about 980° C. in a pipe-gathering portion thereof, and the highest surface temperature of the turbo charger housing was about 1020° C. in a waist gate portion thereof. As a result of the evaluation test, no gas leak and thermal cracking were observed. It was thus confirmed that the exhaust manifold and the turbine housing made of the heat-resistant, austenitic cast steel of the present invention had excellent durability and reliability.

Examples 11–20

Test pieces were prepared from various types of heat-resistant cast steel having compositions shown in Table 6 and tested in the same manner as in Example 1. The results of the tensile test at a room temperature, the tensile test at 1000° C., the thermal fatigue test and the oxidation test, and the drilling test are shown in Tables 7, 8, 9, and 10, respectively.

TABLE 6

| | Additive Component (Weight %) | | | | | | | | | |
|---|---|---|---|---|---|---|---|---|---|---|
| No. | C | Si | Mn | Ni | Cr | W | Nb | N | S | C-Nb/8 |
| 11 | 0.21 | 1.01 | 0.58 | 8.45 | 16.55 | 1.02 | 0.68 | 0.03 | 0.03 | 0.12 |
| 12 | 0.45 | 0.85 | 1.02 | 10.55 | 20.88 | 3.02 | 2.50 | 0.12 | 0.10 | 0.14 |
| 13 | 0.98 | 0.52 | 0.75 | 18.55 | 28.44 | 5.80 | 3.18 | 0.24 | 0.20 | 0.58 |
| 14 | 0.43 | 0.75 | 0.60 | 10.02 | 20.12 | 2.94 | 1.53 | 0.08 | 0.41 | 0.24 |
| 15 | 0.80 | 0.66 | 0.78 | 10.32 | 21.02 | 3.50 | 5.95 | 0.14 | 0.13 | 0.06 |
| 16 | 0.44 | 1.05 | 0.85 | 9.83 | 20.33 | 3.02 | 1.62 | 0.09 | 0.11 | 0.24 |
| 17 | 0.45 | 0.54 | 1.05 | 10.11 | 20.52 | 3.14 | 2.02 | 0.06 | 0.15 | 0.20 |
| 18 | 0.50 | 1.11 | 0.70 | 10.51 | 19.58 | 3.08 | 1.75 | 0.06 | 0.13 | 0.28 |
| 19 | 0.55 | 0.95 | 0.51 | 9.96 | 20.75 | 3.35 | 1.08 | 0.07 | 0.21 | 0.41 |
| 20 | 0.42 | 1.09 | 0.92 | 10.54 | 21.02 | 2.98 | 2.70 | 0.06 | 0.18 | 0.08 |

TABLE 7

| | at Room Temperature | | | |
|---|---|---|---|---|
| Example No. | 0.2% Offset Yield Strength (MPa) | Tensile Strength (MPa) | Elongation (%) | Hardness ($H_B$) |
| 11 | 290 | 500 | 19 | 170 |
| 12 | 350 | 570 | 17 | 179 |
| 13 | 420 | 625 | 5 | 223 |
| 14 | 355 | 555 | 9 | 187 |
| 15 | 390 | 625 | 8 | 187 |
| 16 | 345 | 570 | 10 | 192 |
| 17 | 360 | 560 | 12 | 192 |
| 18 | 365 | 590 | 8 | 197 |
| 19 | 370 | 590 | 6 | 197 |
| 20 | 355 | 565 | 10 | 187 |

TABLE 8

| | at 1000° C. | | |
|---|---|---|---|
| Example No. | 0.2% Offset Yield Strength (MPa) | Tensile Strength (MPa) | Elongation (%) |
| 11 | 55 | 62 | 75 |
| 12 | 60 | 110 | 55 |
| 13 | 80 | 125 | 26 |
| 14 | 67 | 108 | 37 |
| 15 | 78 | 115 | 32 |
| 16 | 64 | 105 | 31 |
| 17 | 66 | 110 | 38 |
| 18 | 69 | 115 | 48 |
| 19 | 68 | 105 | 40 |
| 20 | 66 | 105 | 29 |

TABLE 9

| Example No. | Thermal Fatigue Life (Cycle) | Weight Loss by Oxidation (mg/mm$^2$) |
|---|---|---|
| 11 | 145 | 35 |
| 12 | 160 | 30 |
| 13 | 210 | 18 |
| 14 | 185 | 28 |
| 15 | 200 | 26 |
| 16 | 165 | 30 |
| 17 | 170 | 40 |
| 18 | 180 | 48 |
| 19 | 160 | 50 |
| 20 | 175 | 22 |

TABLE 10

| Example No. | Flank Wear per One Cut Hole (mm) |
|---|---|
| 11 | 0.015 |
| 12 | 0.010 |
| 13 | 0.008 |
| 14 | 0.005 |
| 15 | 0.009 |
| 16 | 0.010 |
| 17 | 0.008 |
| 18 | 0.012 |
| 19 | 0.010 |
| 20 | 0.007 |

As is clear from Table 7, the test pieces of Examples 11–20 are comparable to or even superior to those of Comparative Examples 1–3 with respect to properties at a room temperature. Also, as is clear from Tables 8 and 9, the test pieces of Examples 11–20 are superior to those of Comparative Examples 1–3 with respect to the high-temperature properties (0.2% offset yield strength, tensile strength, thermal fatigue life and weight loss by oxidation). In addition, the test pieces of Examples 11–20 are comparable to the heat-resistant, austenitic cast steel of Comparative Example 4 in mechanical properties.

As is clear from Table 10, since the heat-resistant, austenitic cast steel of the present invention contains appropriate amounts of S and N and has well balanced amounts of C and Nb expressed by (C—Nb/8), it is much superior in machinability to the heat-resistant, austenitic cast steel of Comparative Examples 3 and 4.

Next, the same exhaust manifold and turbine housing as in Example 1 were produced by casting the heat-resistant, austenitic cast steel of Example 7. All of the resulting heat-resistant cast steel parts were free from casting defects. These cast parts were machined to evaluate their machinability. As a result, no problem was found in any cast parts. Further, the exhaust manifold and the turbine housing were mounted to a high-performance, straight-type, four-cylinder, 2000-cc gasoline engine to conduct a durability test in the same manner as in Example 1. As a result of the evaluation test, it was observed that there were no gas leak and thermal cracking, and that the exhaust manifold and the turbine housing made of the heat-resistant, austenitic cast steel of the present invention had excellent durability and reliability.

As described above in detail, the heat-resistant, austenitic cast steel of the present invention has excellent castability, machinability and high-temperature strength without deteriorating a room-temperature ductility, and it can be produced at a low cost. The heat-resistant, austenitic cast steel of the present invention is particularly suitable for exhaust equipment members for engines, such as exhaust manifolds, turbine housings, etc. The exhaust equipment members made of such heat-resistant, austenitic cast steel according to the present invention show excellent castability, machinability and durability.

What is claimed is:

1. A heat-resistant, austenitic cast steel with excellent castability and machinability, said austenitic cast steel having a composition consisting essentially, by weight of:

C: 0.2–0.6%

C—Nb/8: 0.07–0.3%

Si: 0.3–1.5%

Mn: 0.3–1.5%

Ni: 8–15%

Cr: 17–25%

Nb: 1–4%

W: 2.66–4%,

N: 0.03–0.2%, and

Fe and inevitable impurities: balance.

2. The heat-resistant, austenitic cast steel with excellent castability and machinability according to claim 1, wherein W is partially or totally substituted by Mo at a weight ratio of W=2Mo.

3. A heat-resistant, austenitic cast steel with excellent castability and machinability, said austenitic cast steel having a composition consisting essentially, by weight of:

C: 0.3–0.6%

C—Nb/8: 0.07–0.3%

Si: 0.3–1.5%

Mn: 0.3–1.5%

Ni: 8–15%

Cr: 17–25%

Nb: 1–4%

W: 2.66–4%,

N: 0.03–0.2%,

S: 0.03–0.25%, and

Fe and inevitable impurities: balance.

4. The heat-resistant, austenitic cast steel with excellent castability and machinability according to claim 3, wherein W is partially or totally substituted by Mo at a weight ratio of W=2Mo.

5. An exhaust equipment member made of a heat-resistant, austenitic cast steel with excellent castability and machinability according to claim 2.

6. The exhaust equipment member according to claim 5, wherein said exhaust equipment member is an exhaust manifold.

7. The exhaust equipment member according to claim 5, wherein said exhaust equipment member is a turbine housing.

8. An exhaust equipment member made of a heat-resistant, austenitic cast steel with excellent castability and machinability according to claim 6.

9. The exhaust equipment member according to claim 8, wherein said exhaust equipment member is an exhaust manifold.

10. The exhaust equipment member according to claim 8, wherein said exhaust equipment member is a turbine housing.

* * * * *